United States Patent [19]

Nakatomi

[11] Patent Number: 4,770,605

[45] Date of Patent: Sep. 13, 1988

[54] DIFFUSER DEVICE IN A CENTRIFUGAL COMPRESSOR AND METHOD FOR MANUFACTURING THE SAME

[75] Inventor: Hiroshi Nakatomi, Nagasaki, Japan

[73] Assignee: Mitsubishi Jukogyo Kabushiki Kaisha, Tokyo, Japan

[21] Appl. No.: 344,078

[22] Filed: Jan. 28, 1982

[30] Foreign Application Priority Data

| | | | |
|---|---|---|---|
| Feb. 16, 1981 | [JP] | Japan | 56-19391[U] |
| Jun. 10, 1981 | [JP] | Japan | 56-88011 |
| Nov. 28, 1981 | [JP] | Japan | 56-189904 |

[51] Int. Cl.[4] ..... F04D 27/00

[52] U.S. Cl. ..... 415/148; 415/46; 415/164; 415/211

[58] Field of Search ..... 415/148, 149, 150, 157, 415/158, 159, 160, 162, 163, 181

[56] References Cited

U.S. PATENT DOCUMENTS

| | | | |
|---|---|---|---|
| 1,604,328 | 10/1926 | Walker | 415/158 |
| 3,243,159 | 3/1966 | Hefler | 415/150 |
| 3,667,860 | 6/1972 | Endress et al. | 415/158 |
| 3,799,694 | 3/1974 | Duzan | 415/149 R |
| 3,963,369 | 6/1976 | Balje | 415/181 |
| 4,242,040 | 12/1980 | Swearingen | 415/163 |
| 4,302,149 | 11/1981 | Smale | 415/160 |
| 4,378,194 | 3/1983 | Bandukwalla | 415/158 |

*Primary Examiner*—Samuel Scott
*Assistant Examiner*—Carl D. Price
*Attorney, Agent, or Firm*—Wenderoth, Lind & Ponack

[57] ABSTRACT

A diffuser device disposed in a passageway between an air outlet of an impeller and a swirl chamber within a casing in a centrifugal compressor, is formed as divided into a diffuser disc capable of being fixed to a casing and a plurality of blades adapted to be arranged along the circumferential direction of the diffuser disc, and the respective diffuser blades have their one ends fitted in fitting bores drilled in the diffuser disc as arrayed along the circumferential direction as many as the diffuser blades so as to be freely rotatable about the axes of the fitting bores, whereby a blade angle is made variable. Also, a method for assembing such a diffuser device in a desired adjusted condition and a ganged drive mechanism for the diffuser blades for bringing the blade angles of the plurality of diffuser blades simultaneously into a desired adjusted condition are disclosed.

1 Claim, 7 Drawing Sheets

DIFFUSER DEVICE IN A CENTRIFUGAL COMPRESSOR AND METHOD FOR MANUFACTURING THE SAME

BACKGROUND OF THE INVENTION

The present invention relates to a centrifugal compressor such as an exhaust gas turbine supercharger or the like, and more particularly to a diffuser device disposed in a passageway between an air outlet of an impeller and a swirl chamber within a casing in such a centrifugal compressor and a method for manufacturing the diffuser device.

One example of an essential structure on the blower side of an exhaust gas turbine supercharger in the prior art is illustrated in cross-section in FIG. 1. In the structure shown in FIG. 1, externally supplied fresh air is compressed by front blades 5 and an impeller 6 mounted on a rotor shaft 7 which is in turn driven by an exhaust gas turbine, and then an air flow having a pressure and a flow rate required by a diesel engine is formed by a diffuser device 4' and is supplied to a diesel engine through a swirl chamber formed by an outer volute casing 1 and an inner volute casing 2. The diffuser device 4' is fixedly secured to the inner volute casing 2 by means of bolts 20. The air flow supplied by the supercharger is matched with the pressure and flow rate required by the diesel engine generally by means of the diffuser device 4', front blades 5 and impeller 6, but it is a common practice to achieve fine adjustment by means of the diffuser device 4'. In the illustrated construction, since the diffuser device 4' has an integral structure, varieties of specifications required for the diffuser device 4' are so many that even if calculations matching are conducted with the highest class of electronic computer known at present, normally it is required to prepare diffuser devices 4' having two different specifications close to a desired specification. Increase of the construction time, cost and amount of storage due to the necessity for such diffuser devices will raise the overall cost of a supercharger. Moreover, there is a shortcoming that the preparation of two or more diffuser devices require a relatively large investment.

SUMMARY OF THE INVENTION

It is therefore one object of the present invention to provide a diffuser device in a centrifugal compressor which can achieve required matching of a pressure and a flow rate with only one variety of structure.

Another object of the present invention is to provide a method for manufacturing a diffuser device in a centrifugal compressor, by which an adjustable diffuser device can be easily and accurately assembled, and which method is suitable for mass-production at low cost.

Still another object of the present invention is to provide an adjustable diffuser device in a centrifugal compressor, which includes ganged drive means capable of simultaneously and accurately achieving adjustment of a plurality of diffuser blades.

According to one feature of the present invention, there is provided a diffuser device disposed in a passageway between an air outlet of an impeller and a swirl chamber within a casing in a centrifugal compressor, which diffuser device is divided into a diffuser disc capable of being fixed to the casing and a plurality of diffuser blades adapted to be arranged in the circumferential direction of the diffuser disc, and in which the respective diffuser blades have their one ends fitted in bores drilled in the diffuser disc in the circumferential direction and equal in number to the diffuser blades so as to be freely rotatable about the axies of the bores, whereby the blade angle is made variable.

According to another feature of the present invention, there is provided a method for manufacturing a diffuser device in a centrifugal compressor, consisting of the steps of dividing the diffuser device into a diffuser disc and a plurality of diffuser blades produced separately, forming a cylindrical boss integrally with each of the diffuser blades, fitting the bosses of the respective diffuser blades in bores drilled in the diffuser disc, then adjusting the inlet width and outlet width between the adjacent diffuser blades by means of positioning jigs, and fixing the diffuser blades with respect to the diffuser disc.

BRIEF DESCRIPTION OF THE DRAWINGS

In the accompanying drawings

DESCRIPTION OF PREFERRED EMBODIMENTS

The present invention is generally applicable to a centrifugal compressor such as an air compressor, a gas turbine, an exhaust gas turbine supercharger, a gas compressor, a centrifugal pump, etc., but in the following, for convenience of explanation, it will be described in more detail in connection with its preferred embodiments as applied to an exhaust gas turbine supercharger.

Figure 1:
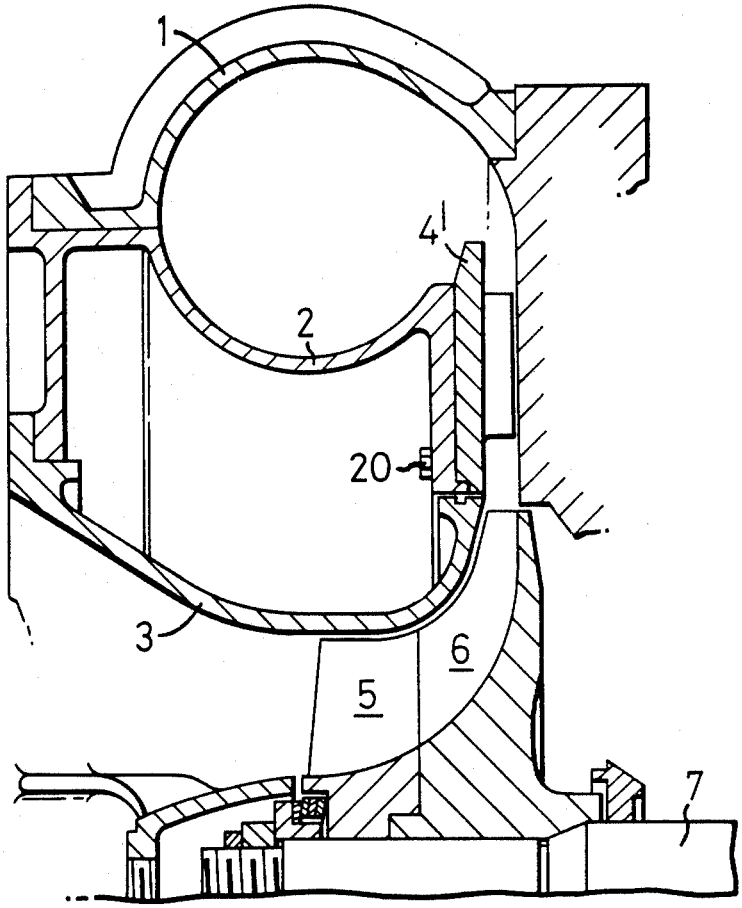
FIG. 1 is a cross-section view showing one example of an essential structure on the blower side of an exhaust gas turbine supercharger of the prior art, FIG. 2(*a*) is a cross-section similar to FIG. 1 of the essential structure on the blower side of an exhaust gas turbine supercharger according to one preferred embodiment of the present invention, FIG. 2(*a*) is a sectional view taken along line A—A in FIG. 2(*b*) as viewed in the direction of the arrows, FIG. 3(*a*) is an enlarged cross-section showing the details of the mounting of an adjustment flange and diffuser blades onto a diffuser disc generally illustrated in FIGS. 2(*a*) and 2(*b*), FIG. 3(*b*) is a plan view of the part of the diffuser divice illustrated in FIG. 3(*a*), FIG. 4(*a*) is a cross-section showing a diffuser device according to another preferred embodiment of the present invention, FIG. 4(*b*) is a plan view of the diffuser device illustrated in FIG. 4(*a*), FIG. 4(*c*) is an enlarged side view of a diffuser blade in the diffuser device of FIG. 4(*b*), FIG. 4(*d*) is a cross-section of the diffuser blade taken along line B—B in FIG. 4(*c*) as viewed in the direction of the arrows, FIG. 5(*a*) is a cross-section similar to FIG. 2(*a*) showing a diffuser device according to still another preferred embodiment of the present invention, in which a ganged drive mechanism for simultaneously adjusting each diffuser blade is included, FIG. 5(*b*) is a cross-section taken along line Y—Y in FIG. 5(*a*) as viewed in the direction of the arrows, FIG. 6(*a*) is a diagram showing the geometrical relation between two adjacent sprockets in the preferred embodiment illustrated in FIGS. 5(*a*) and 5(*b*), FIG. 6(*b*) is a diagram showing the geometrical relation between sprockets and a roller chain in the same preferred embodiment, FIG. 6(*c*) is a cross-section taken along line X—X in FIG. 6(*b*) as viewed in the direction of the arrows, FIG. 7(*a*) is a diagram showing the geometrical relation between two alternate sprockets in a ganged drive mechanism for diffuser blades according to yet another preferred embodiment of the present invention, FIG. 7(*b*) is a diagram showing the geometrical relation between sprockets and roller chains in the preferred embodiment illustrated in FIG. 7(*a*), and FIG. 7(*c*) is a cross-section taken along line X'—X' in FIG. 7(*b*) as viewed in the direction of the arrows.
Figure 2A:
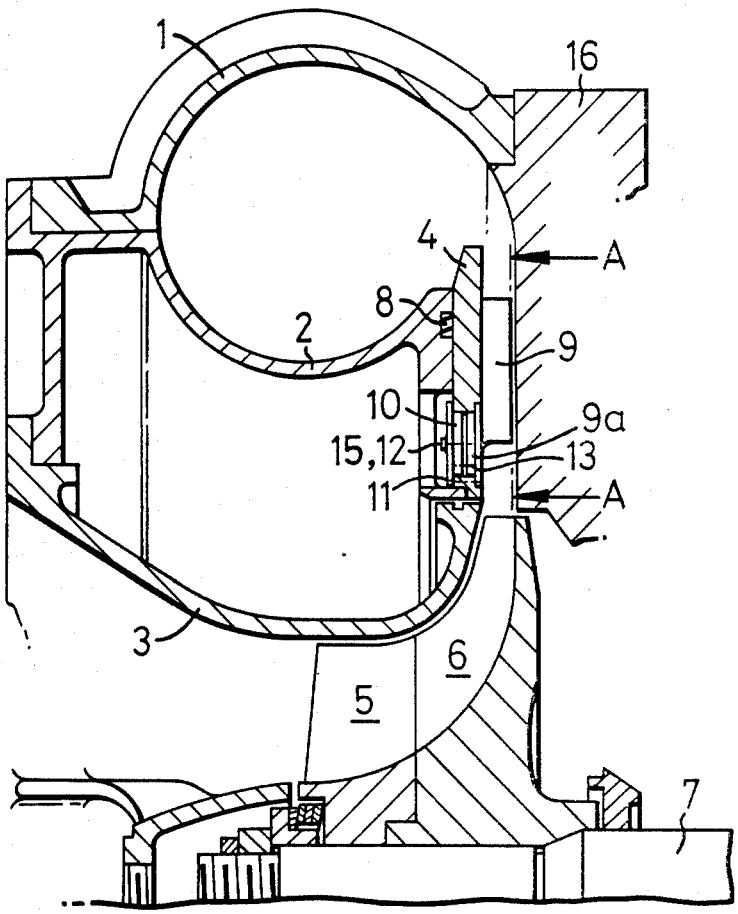
Figure 2B:
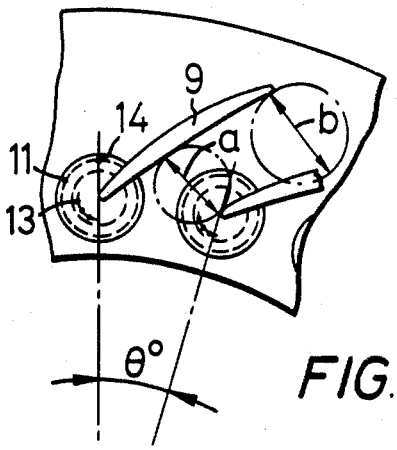
Figure 3A:
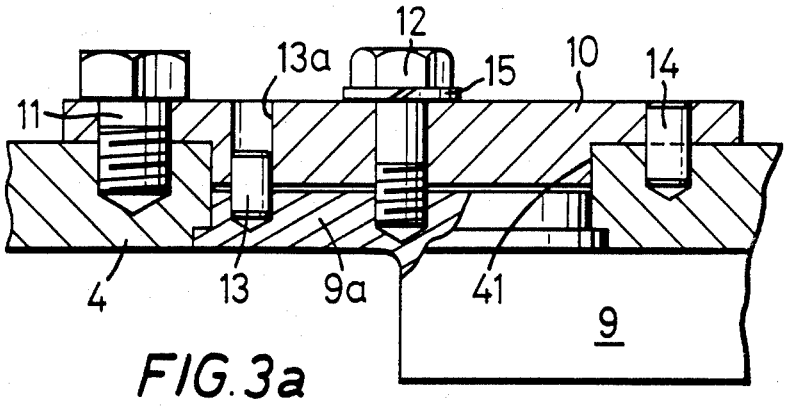
Figure 3B:
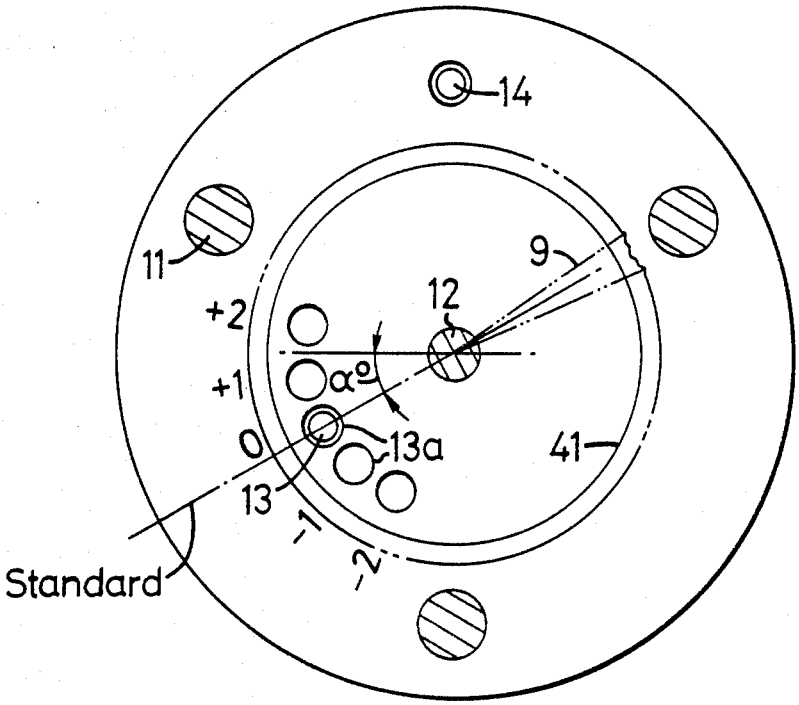
Figure 4A:
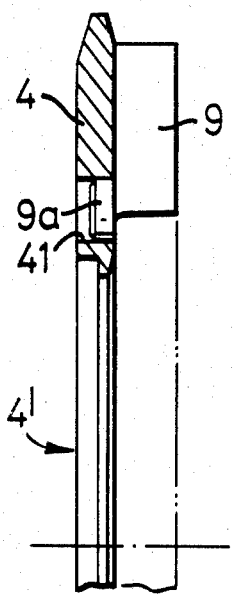
Figure 4B:
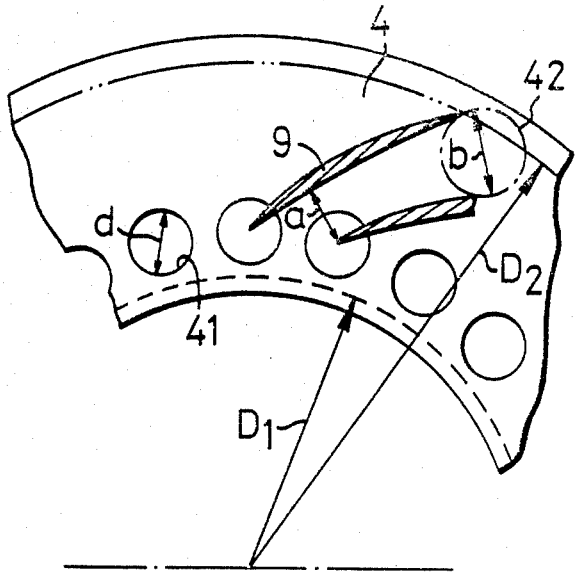
Figure 4C:
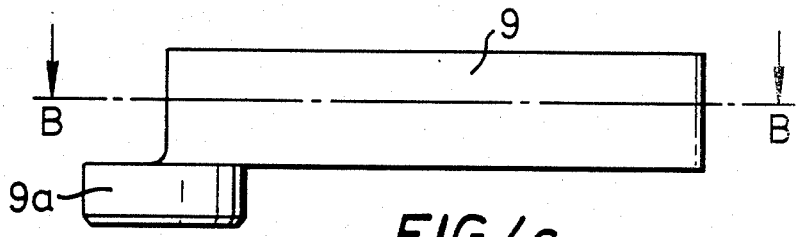
Figure 4D:
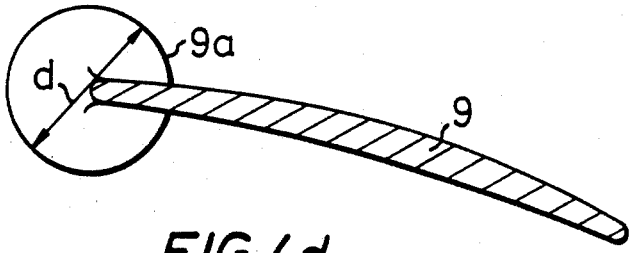

In FIGS. 2(*a*), 2(*b*), 3(*a*) and 3(*b*) which illustrate one preferred embodiment of the present invention, reference numerals 1, 2, 3, 5, 6 and 7 designate the same members as those given like reference numerals in FIG. 1 which shows one example of the prior art structure. In the illustrated structure, the diffuser device 4' provided in the passageway between the impeller 6 and the swirl chamber delimited by the outer volute casing 1 and the inner volute casing 2 in the prior art structure is divided into a diffuser disc 4 mounted on a wall of a similar passageway and diffuser blades 9 adapted to be connected to the diffuser disc 4.

The diffuser blade 9 is provided with a boss 9*a* on the side of its front edge, and the boss 9*a* has a positioning pin 13 fixedly secured thereto and a threaded hole formed therein so that a center bolt 12 may be screwed into the hole through a spring washer 15.

An adjustment flange 10 is provided with a cylindrical protrusion having the same diameter as the above-described boss 9*a*. In the cylindrical protrusion are drilled an appropriate number of positioning bores 13*a* adapted to have the above-described positioning pin 13 selectively inserted therein, at predetermined intervals in the circumferential direction of the adjustment flange 10, and also at the center of the cylindrical protrusion is drilled a bolt passage bore that is coaxial with the threaded hole in the above-described boss 9*a*. In the peripheral portion of the adjustment flange 10 are drilled other bores for receiving fixing bolts 11 and parallel pins 14 to be used for relative positioning of the adjustment flange 10 and the diffuser disc 4.

In the diffuser disc 4 is formed a flange receiving bore 41, into which the boss 9*a* of the diffuser blade 9 and the cylindrical protrusion of the adjustment flange 10 are inserted and opposed to each other. Then, by inserting the positioning pin 13 into a selected positioning bore 13*a* and fastening the bolts 11 and 12 to fix the relative positions of the adjustment flange 10, diffuser blade 9 and diffuser disc 4, the diffuser blades 9 can be mounted on the diffuser disc 4 at a predetermined mounting angle, that is, so as to have predetermined inlet angle $\alpha°$, inlet width a and outlet width b as indicated in FIGS. 2(*b*) and 3(*b*).

An O-ring 8 is provided in tight contact with the diffuser disc 4 on the side of a thrust bearing therefor in order to prevent leakage of compressed air and vibrations of the diffuser blades 9.

Now a description will be of the operation of the diffuser device constructed as described above. Fresh air is sucked from an inner cylinder side of a guide casing 3, then compressed by the front blades 5, impeller 6 and rotor shaft 7, and further raised in pressure by means of the diffuser disc 4 and the diffuser blades 9. Thereafter the compressed air is supplied at a necessary pressure and a required flow rate to a diesel engine through the swirl chamber delimited by the outer volute casing 1 and the inner volute casing 2.

In the event that it becomes necessary to change the specifications of the diffuser, change of the inlet angle $\alpha°$, inlet width a and outlet width b can be effected in a simple manner by removing the guide casing 3, drawing the inner volute casing 2 away from the turbine housing 16 a distance of about 5–10 mm, removing the bolts 11 and 12 and spring washer 15 which fix the adjusting flange 10, extracting the positioning pin 13 from the positioning bore 13*a* located at a reference index point 0 for the inlet angle $\alpha°$ of the diffuser blade 9 and inserting it into another positioning bore 13*a* located at an adjacent index point $+1$ or $-1$ while slightly separating the adjustment flange 10 from the boss 9*a*, and then assembling the diffuser device in the sequence opposite to the above-described disassembly. In this case, the inner diameter of the array of the diffuser blades 9 serves as a reference for every adjustment.

As will be seen from FIG. 2(*b*), the pitch $\theta$ of the diffuser blades 9 is $\theta=360°/Z$, where Z represents the number of the diffuser blades 9. In the case where the adjustment of the diffuser blades 9 cannot be achieved only be means of the positioning pin 13 and the positioning bores 13*a*, instead of replacing the diffuser blades 9, adjustment flanges 10 having a different reference value of the inlet angle $\alpha_o$ could be prepared and used to replace the previous ones. Then the diffuser device can be reassembled in a simple manner so as to achieve any desired blade angle.

The diffuser device according to the present invention which is constructed as described above has the following advantages. That is, in the event that it becomes necessary to change the specifications of a diffuser device for matching a diesel engine and an exhaust gas turbine supercharger, the necessary specifications of the diffuser device can be achieved in a simple and less expensive manner by replacing inexpensive adjustment flanges and/or selecting new positioning bores, instead of replacing the entire diffuser device or the expensive diffuser blades. In other words, the advantages are as follows:

(1) The cost is low.
(2) Change of the specifications of a diffuser can be achieved in a simple manner by minor disassembly of an exhaust gas turbine supercharger on a diesel engine.
(3) The adjustment flange 10 can be reused.
(4) The inlet angle $\alpha°$, inlet width a and outlet width b of the diffuser blades 9 can be selectively varied owing to the use of the adjustment flange 10.
(5) Adjustment of the diffuser device can be achieved without completely removing it from an exhaust gas turbine supercharger.

It is to be noted that while the bosses receiving bores 41 were provided on the inner diameter end of the array of diffuser blades in the above-described embodiment, it is also possible to arbitrarily select the positions of the bosses and to effect adjustment in a similar manner to the above-described embodiment by taking the diameter of the selected positions in the array of diffuser blades as a reference However, due to interference with the inner volute casing 2, depending upon the selected reference diameter, sometimes it may happen that change of the specifications cannot be achieved unless the diffuser device is removed from the supercharger.

Now a description will be given with reference to FIGS. 4(*a*) to 4(*d*) of a diffuser device according to another preferred embodiment of the present invention in which the blade angle of diffuser blades and accordingly the inlet width and outlet width between diffuser blades is made continuously adjustable without employing the positioning pin 13 as used in the preceding embodiment, and a method for manufacturing the same diffuser device.

In FIGS. 4(*a*) to 4(*d*), the diffuser disc 4 is a doughnut-shaped disc with boss receiving bores 41 having a diameter d drilled at an equal pitch along its inner diameter portion in a number equal to the number Z of diffuser blades 9.

Each diffuser blade 9 has an airfoil cross-section associated with a cylindrical boss 9*a* having a diameter: d centered at the front edge, and it is produced by precision casting or precision forging.

With regard to the configuration of the blade 9, in a diffuser device having a low pressure ratio it has a rectilinear cross-section, while in a diffuser device having an increased pressure ratio and required to have excellent performance it has an airfoil cross-section.

Upon assembly, diffuser blades 9 are assembled by inserting their bosses 9*a* into the corresponding bores 41 in the diffuser disc 4, and the desired inlet width a and outlet width b are preset by transversely moving the rear edges of the diffuser blades 9, and then, while holding the diffuser blades in this position by means of jigs so as to prevent further movement, brazing of bosses 9*a* on the diffuser disc 4 and the diffuser blades 9 into the receiving bore 41 bosses 9*a* is effected within a thermostat or within an argon atmosphere to bond them together, and thereby the desired specifications of the diffuser device can be achieved.

In summary, a diffuser device 4' is produced in the form of a diffuser disc 4 and separate diffuser blades 9, and after the desired inlet angle, outlet angle, inlet width and outlet width have been preset by means of positioning jigs by transversely moving the rear edges of the diffuser blades, the diffuser blades 9 are bonded to the diffuser disc 4.

According to the second preferred embodiment of the present invention constructed as described above, the following advantages can be obtained owing to the fact that boss receiving bores arrayed at an equal pitch are preliminarily formed in the diffuser disc and cylindrical bosses formed at one ends of the diffuser blades are fitted into these bores:

(a) Diffuser blades can be preset precisely at an equal pitch.
(b) Adjustment of the inlet width and outlet width can be achieved easily by merely moving the ends of the diffuser blades remote from the bosses.
(c) A boss formed integrally with a diffuser blade can serve as a reinforcement for the diffuser blade, especially for its thin inlet end portion, and also makes positioning of the diffuser blade simple.
(d) Rigid mounting of a diffuser blade onto a diffuser disc is facilitated, and also there is no fear that the diffuser blade will tilt during brazing.
(e) Exchangeability of diffuser blades is enchanced, and as a result, diffuser blades can be mass-produced at a low cost and can be assembled into products within a short period.
(f) With regard to the set angle of the diffuser blades, it is not always expected that the best result will be obtained by exactly following the design of the angle, and in the event that one fails to obtain the best result, the diffuser device according to the above-described embodiment is especially effective for determining the set angle by seeking the optimum condition by varying the inlet angle, outlet angle, inlet width and outlet width.

It is to be noted that although the size of the boss is restricted in view of the size of the edge area of the diffuser disc, for the purpose of fully realizing the above-described advantages it is preferable to select a diameter of the boss which is not so small. That is, the largest diameter within the range allowed on the diffuser disc should preferably be selected. However, since the disc itself does not any special mechanical strength, with respect to this point there is no need to impose any restriction.

With regard to the mode of bonding the diffuser blades to the diffuser disc, there are the following alternative ways:

(1) When employing an inner diameter $D_1$ (FIG. 4(*b*)) of an array of diffuser blades as a reference:

Receiving bores 41 for mounting diffuser blades 9 are formed on the inner diameter portion of a diffuser disc 4, and bosses 9*a* connected with the diffuser blades 9 by being centered at the radially inner edges of the blades.

(2) When employing an outer diameter $D_2$ (FIG. 4(*b*)) of an array of diffuser blades as a reference:

Receiving bores 42 for mounting diffuser blades 9 are formed on the outer diameter portion of a diffuser disc 4, and bosses 9*a* are connected with the diffuser blades 9 by being centered at the radially outer edges of the blades.

(3) When employing a circle having an arbitrary diameter in an array of diffuser blades as a reference:

Receiving bores for mounting diffuser blades are formed along a circle having an arbitrary diameter on a diffuser disc 4, and bosses 9*a* are connected with diffuser blades 9 by being centered at arbitrary points on the blades.

In every case, when providing an inlet width a and an outlet width b the diffuser blades are simultaneously adjusted by positioning jigs after transversely moving the diffuser blades about their bosses, and then the diffuser blades are fixed at the adjusted positions and bonded to the diffuser disc by brazing.

As described above, while the position on a diffuser blade where a boss is formed could be any place, for the purpose of adjustment of the mounting angle and enhancement of the reinforcement effect, the position (1) as described above is most preferable.

Summarizing the method for manufacturing a diffuser device according to the above-described embodiment, it consists of the following four steps:

(1) A cylindrical boss is connected with a diffuser blade by being centered at the front or rear edge of the diffuser blade on its inlet end or on its outlet end.
(2) Bores are drilled at an equal pitch in a diffuser disc by employing a blade inlet or a blade outlet as a reference to be used as a reference for mounting diffuser blades.
(3) Diffuser blades are produced by precision casting or precision forging.
(4) Diffuser blades are brazed to a diffuser disc within a thermostate or within an argon atmosphere.

As a result of such structure and/or such method for manufacture of a diffuser device, the following advantages can be obtained:

(1) Where the boss is mounted on the inlet end, the structure can withstand a high frequency vibration induced by an impeller well because the blade and the boss are integrally fixed to the diffuser disc.

(2) The mass-productivity is high, and hence the manufacturing cost can be reduced.

(3) Regardless of respective specifications, a diffuser disc and diffuser blades of a single type can be used in common.

(4) The manufacturing period can be shortened from 3–4 months to 10–15 days.

Now two other preferred embodiments of the present invention, in which adjustment of diffuser blades in a diffuser device is not effected one by one for individual blades but is effected by means of a ganged drive mechanism which enables all the diffuser blades to be rotated simultaneously in the same phase, will be explained in the following with reference to FIGS. 5(*a*), 5(*b*), 6(*a*), 6(*b*) and 6(*c*) and FIGS. 7(*a*), 7(*b*) and 7(*c*), respectively.

Figure 5B:
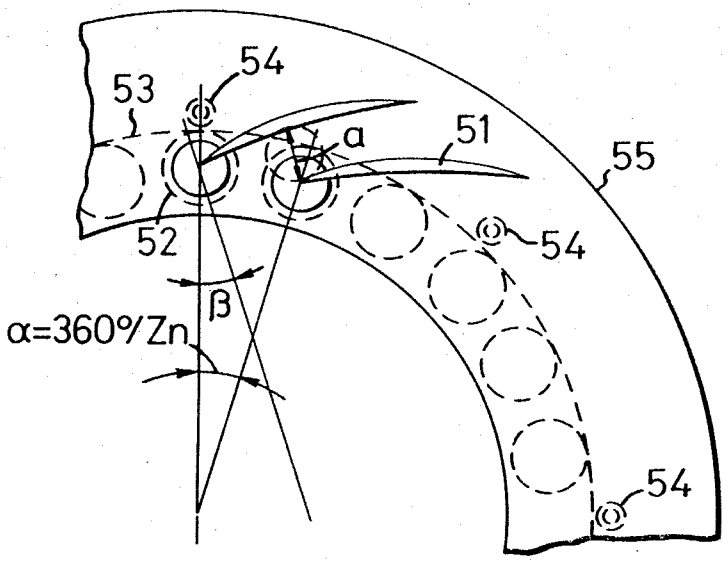
Figure 5A:
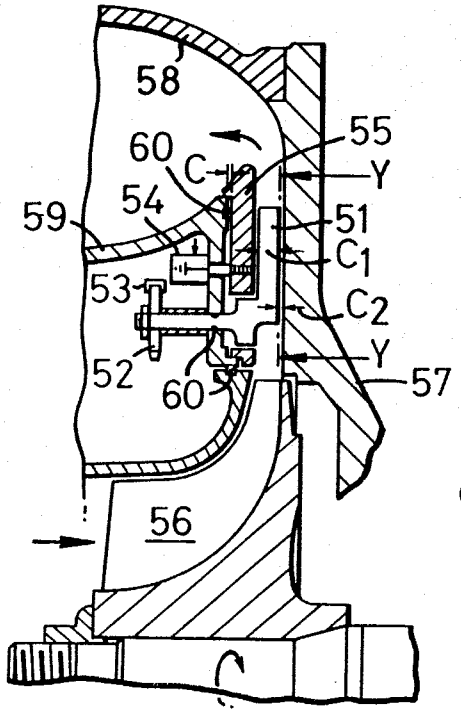

In FIGS. 5(*a*), 5(*b*), 6(*a*), 6(*b*) and 6(*c*), reference numeral 51 designates diffuser blades provided in the gas flow path of a blower, numeral 52 designates a blade sprocket mounted on a rotary shaft of the diffuser blades 51 extending through an inner volute casing 59, numeral 53 designates a roller chain would around a plurality of sprockets 52, and numeral 55 designates a diffuser disc which is interposed between the diffuser blades 51 and the wall surface of the inner volute casing 59 so as to be displaceable in the direction of the rotary shaft of the diffuser blades 51. Reference numeral 54 designates a schematically shown spring-loaded cylinder which either pulls the diffuser disc 55 towards the inner volute casing 59 or pushes it away from the latter. Reference numeral 58 designates an outer volute casing, and reference numeral 60 designates an O-ring provided for the purpose of preventing pressurized gas from escaping through the clearance between the back surface of the diffuser disc 55 and the inner volute casing. Reference numeral 61 designates a shaft for externally driving a chain drive sprocket 52'. It is to be noted that the driving of the diffuser blades 51 could be achieved from the side of the turbine casing 57 on the opposite side of diffuser from the volute casings. Reference numeral 56 designates an impeller of the blower.

Now a description will be given of the operation of the diffuser device constructed in the above-described manner. By actuating the spring-loaded cylinder 54 with compressed air or hydraulic pressure, the diffuser disc 55 is pulled towards the inner volute casing 59 a distance C to form clearances $C_1$ and $C_2$, respectively, ahead of and behind the diffuser blades 51. With the blades in this condition, the drive shaft 61 is driven in rotation to turn drive sprocket 52' to drive roller chain 53 to in turn drive the respective sprockets 52 and thus rotate blades 51, whereby the diffuser blades 51 are adjusted to the desired inlet angle $\beta$ and to have the desired inlet width a, and thus the desired specifications of the diffuser device can be achieved.

Figure 6C:
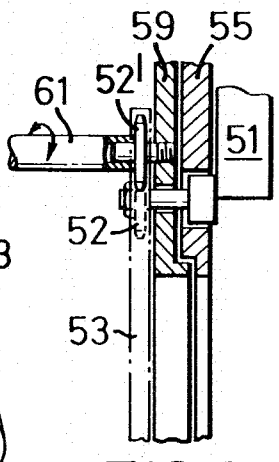
Figure 6B:
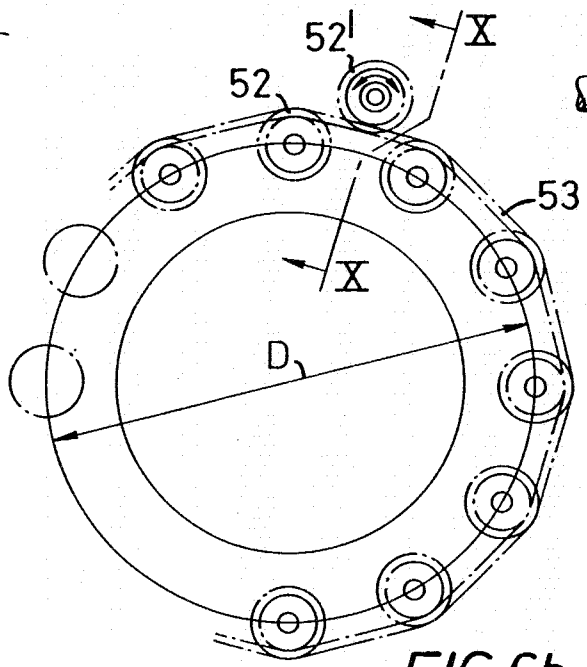
Figure 6A:
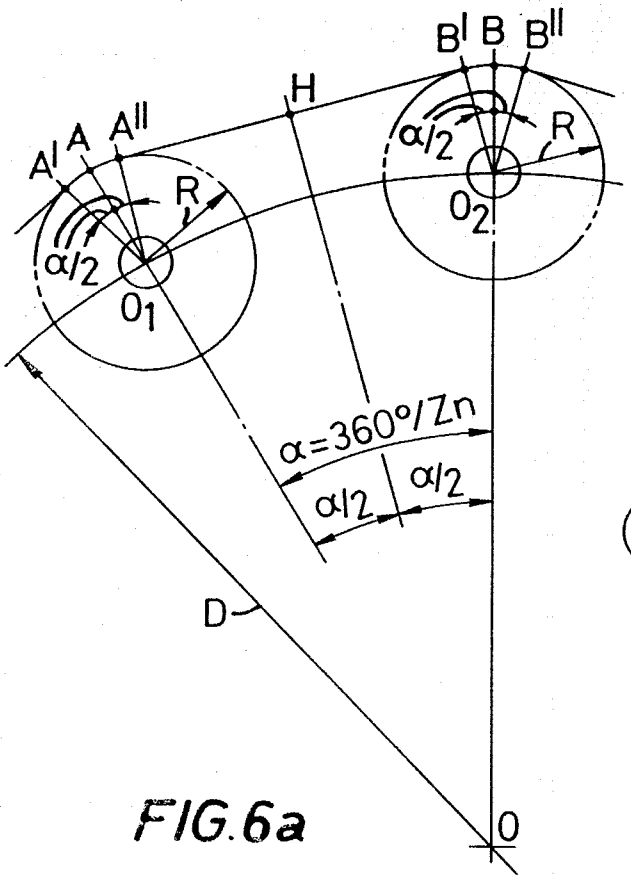

With regard to the change of the blade angle by employing the inner diameter of the blade array as a reference, a description will be given with reference to FIGS. 6(*a*), 6(*b*) and 6(*c*). In these figures, representing the number of the diffuser blades 51 by Zn, the center of the diffuser blade array by O, the centers of rotation for adjustment of the respective diffuser blades by $O_1$, $O_2$, . . . $O_n$, the central angle of the arc $O_1O_2$ by $\alpha=360°/Zn=\angle O_1OO_2$, the radius of the sprockets for the respective diffuser blades by R, and the diameter of the circle passing through the centers $O_1$, $O_2$, . . . $O_n$ by D, the amount of movement of every point on the respective sprockets 52 when driving the sprockets for the respective diffuser blades by stretching a roller chain around the respective sprokets is calculated as follows:

(1) Common tangential lines are drawn for two circles having a diameter R and representing the sprockets having two adjacent centers ($O_n$–$O_1$, $O_1$–$O_2$, $O_2$–$O_3$, etc.), and the common points between the circles $O_1$, $O_2$, . . . and the common tangential lines are designated by A', A'', B', B'', . . .

(2) An intersection between a common tangential line for two adjacent circles representing sprockets and a bisector of a central angle $\alpha$ of a regular n-angle polygon determined by the number of blades Zn, is denoted by H. Then, an equation of $\angle AOH-(\alpha/2)=\angle BOH$ is fulfilled.

Then, according to the law of trigonometry and the above assemptions (1) and (2), the following relations are derived.

$$\angle AO_1A''=\angle AOH=(\alpha/2)$$

$$\angle BO_2B'=\angle BOH=(\alpha/2)$$

hence, we obtain $\angle AO_1A''=\angle BO_2B'$

Therefore, when a point A'' on a circle having a radius R and its center at $O_1$ is moved to a point A, a point B on a circle having a radius R and its center at $O_2$ which circle represents a sprocket coupled via a roller chain to the sprocket represented by the former circle $O_1$ is moved exactly to a point B'.

The diffuser device according to the above-described embodiment of the present invention provides the following advantages.

(1) The clearances $C_1$ and $C_2$ ahead of and behind the diffuser blades can be varied between the period when the diffuser device is operating and the period when the inlet angle $\beta$ is being varied. Therefore, during operation the diffuser device is operated with minimum clearances near to zero, hence performance is improved and generation of vibrations is limited.

(2) By initially selecting the clearance C to be a maximum value that is allowable in view of performance, during the period of varying the inlet angle $\beta$ of the diffuser blades driving of the rotary shaft 61 can be achieved with a small torque while maintaining the clearance $C_1$ and $C_2$ large.

(3) Since commercially available standard parts can be used, and since the number of parts is reduced, the cost of the diffuser device is lowered.

(4) The manufacturing period can be shortened owing to the use of commercially available parts.

(5) If adjustable pieces are used in the roller chain, fine adjustment of the diffuser blades during assembly can be made.

Figure 7C:
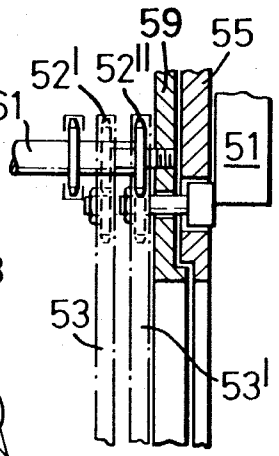
Figure 7B:
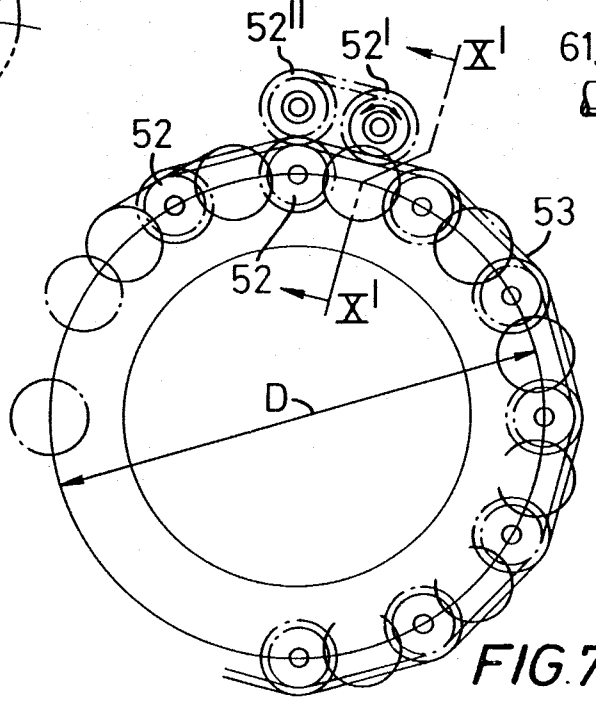
Figure 7A:
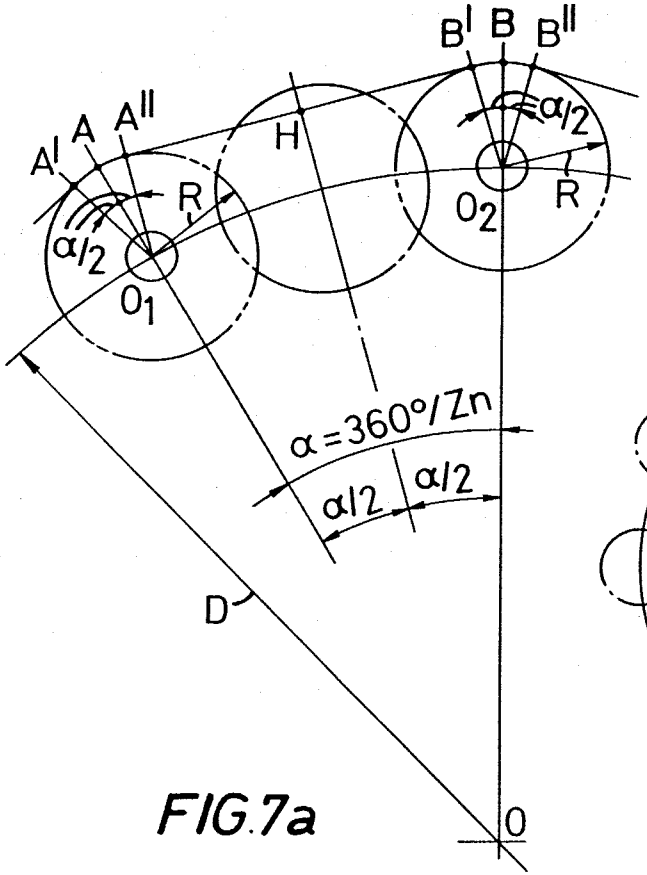

FIGS. 7(*a*), 7(*b*) and 7(*c*) show still another preferred embodiment of the present invention. Where the number of the diffuser blades 51 is increased to the extent that the adjacent sprockets interfere with each other if the preceding embodiment is employed, this modified embodiment can be conveniently employed, in which the axial positions of the sprockets for the respective diffuser blades are alternately varied, the respective groups of sprockets are coupled with two separate loops of roller chains 53 and 53' for which two separate drive sprockets 52' and 52'' are provided so as to drive the respective groups of sprockets through the same angle. The effects and advantages of the diffuser device according to this embodiment are exactly the same as those of the preceding embodiment.

What is claimed is:

1. A diffuser device for mounting in a passageway in a centrifugal compressor between an annular outlet of an impeller and an annular inlet to a swirl chamber within a volute casing in the compressor, said diffuser device comprising:

a diffuser disc adapted to be fixed to the casing and having receiving bores circumferentially spaced therearound;

a plurality of diffuser blades arrayed along the diffuser disc in the direction of the circumference thereof, said diffuser blades each having a part on one end thereof freely rotatably fitted in a corresponding one of said bores, whereby the diffuser blades can be rotated about the axes of the bores for varying the blade angle of the diffuser blades, said diffuser blades being mounted on said diffuser disc with the edge surfaces of said diffuser blades opposed to the side surfaces of the volute casing defining said passageway, and said diffuser disc being movable in the casing in the direction of the axis of rotation of the impeller for varying the clearance ahead of and behind said diffuser blades;

a disc drive fluid pressure piston-cylinder means having a piston fixedly secured to said diffuser disc and operable independently of the pressure within the compressor for reciprocating said diffuser disc in the direction of the axis of rotation of the impeller; and sprockets fixedly secured to said respective diffuser blades, a chain extending around the sprockets for the respective diffuser blades, and a drive means for driving said chain for rotating said sprockets about the axes of said bores.

* * * * *